US008497827B2

(12) United States Patent
Lee

(10) Patent No.: US 8,497,827 B2
(45) Date of Patent: Jul. 30, 2013

(54) ORGANIC LIGHT EMITTING DISPLAY AND METHOD FOR DRIVING THE SAME

(75) Inventor: Baek-Woon Lee, Yongin-si (KR)

(73) Assignee: Samsung Display Co., Ltd. (KR)

( * ) Notice: Subject to any disclaimer, the term of this patent is extended or adjusted under 35 U.S.C. 154(b) by 935 days.

(21) Appl. No.: 12/154,180

(22) Filed: May 20, 2008

(65) Prior Publication Data

US 2009/0058772 A1 Mar. 5, 2009

(30) Foreign Application Priority Data

Sep. 4, 2007 (KR) ..... 10-2007-0089528

(51) Int. Cl.
*G09G 3/32* (2006.01)
*G09G 5/10* (2006.01)

(52) U.S. Cl.
USPC ..... 345/82

(58) Field of Classification Search
USPC ..... 345/82, 77, 76, 83
See application file for complete search history.

(56) References Cited

U.S. PATENT DOCUMENTS

| | | | | |
|---|---|---|---|---|
| 6,157,356 | A * | 12/2000 | Troutman | 345/82 |
| 7,598,731 | B1 * | 10/2009 | Masleid et al. | 324/762.08 |
| 7,639,849 | B2 * | 12/2009 | Kimpe et al. | 382/128 |
| 7,834,825 | B2 * | 11/2010 | Mizukoshi et al. | 345/77 |
| 2002/0021294 | A1 * | 2/2002 | Jun | 345/204 |
| 2003/0234392 | A1 * | 12/2003 | Kung et al. | 257/13 |
| 2004/0066388 | A1 * | 4/2004 | Leather et al. | 345/611 |
| 2005/0052350 | A1 * | 3/2005 | Mizukoshi et al. | 345/55 |
| 2005/0237318 | A1 * | 10/2005 | Inoue et al. | 345/207 |
| 2006/0001624 | A1 * | 1/2006 | Lee | 345/82 |
| 2006/0214940 | A1 * | 9/2006 | Kinoshita et al. | 345/589 |
| 2006/0262147 | A1 * | 11/2006 | Kimpe et al. | 345/690 |
| 2006/0284802 | A1 * | 12/2006 | Kohno | 345/76 |
| 2007/0008251 | A1 * | 1/2007 | Kohno et al. | 345/76 |
| 2007/0236419 | A1 * | 10/2007 | Wacyk et al. | 345/76 |
| 2008/0068310 | A1 * | 3/2008 | Choi et al. | 345/82 |
| 2008/0074361 | A1 * | 3/2008 | Lee et al. | 345/77 |
| 2008/0186264 | A1 * | 8/2008 | Lee | 345/82 |
| 2008/0204438 | A1 * | 8/2008 | Song et al. | 345/207 |

FOREIGN PATENT DOCUMENTS

| | | |
|---|---|---|
| JP | 11-282420 | 10/1999 |
| JP | 2005-284172 | 10/2005 |
| JP | 2007-18876 | 1/2007 |

OTHER PUBLICATIONS

English Language Abstract, Publication No. 1999-282420, Oct. 15, 1999, 1 p.
English Language Abstract, Publication No. 2005-284172, Oct. 13, 2005, 1 p. English Language Abstract, Publication No. 2007-018876, Jan. 25, 2007, 1 p.

* cited by examiner

*Primary Examiner* — Alexander S Beck
*Assistant Examiner* — Mihir Rayan
(74) *Attorney, Agent, or Firm* — Innovation Counsel LLP

(57) ABSTRACT

A method of driving an organic light emitting display device includes generating a luminance map for a plurality of pixels by applying the same driving voltage to driving transistors formed in the plurality of pixels of a panel and by capturing luminances of the pixels, generating a threshold voltage map by calculating threshold voltage correction values that compensate for threshold voltages of the driving transistors associated with the luminances of the pixels. A lookup table is generated by sampling the threshold voltage correction values stored in the threshold voltage map. Threshold voltage correction values are restored by interpolating the sampled threshold voltage correction values, and correcting a driving voltage by adding the restored threshold voltage correction values to input gray level data and by providing the added value to the panel.

7 Claims, 5 Drawing Sheets

ORGANIC LIGHT EMITTING DISPLAY AND METHOD FOR DRIVING THE SAME

RELATED APPLICATIONS

This application claims priority of Korean Patent Application No. 10-2007-0089528 filed in the Korean Intellectual Property Office on Sep. 4, 2007, the entire disclosure of which is incorporated herein by reference.

BACKGROUND OF THE INVENTION

1. Field of the invention

The present disclosure relates to an organic light emitting display ("OLED") device, and more particularly, to an active matrix OLED device and a method for driving the same.

2. Description of the Related Art

Recently, a display device that is lightweight, compact and requires low power consumption is in demand for use in mobile communications. An OLED device is a self-luminous device while generates light by itself, provides superior viewing angle and a contrast ratio relative to a liquid crystal display ("LCD") device. In addition, since the OLED device does not require a backlight unit, it has the additional advantages of reduced weight, thickness, and power consumption.

The OLED device is classified into a passive matrix type and an active matrix type. In the passive matrix type OLED device, an anode and a cathode are formed to cross each other and the OLED device is driven by selection of a line. The active matrix type of OLED device controls a current flowing into an OLED element by maintaining a driving voltage switched by a switching transistor by a capacitor and applying the driving voltage to a driving transistor.

However, in a conventional active matrix OLED device, a characteristic of a threshold voltage of the driving transistor varies according to a location of an OLED panel. The variation of the threshold voltage is the result of a process error during fabricating a thin film transistor. Accordingly, even though the same driving voltage is applied to driving transistors of pixels, the current flowing into OLED elements may be different from each other. As a result, the respective pixels display images with different luminances. In other words, the variation of the threshold voltage of the driving transistor of the OLED panel appears as non-uniformity of the luminance and a spotted image.

When the variation of the threshold voltage of the driving transistor shows a different white level and a different black level in the OLED panel, characteristics of each OLED panel, such as a luminance and a contrast ratio, are not constant according to the OLED panel.

BRIEF SUMMARY OF THE INVENTION

The present disclosure provides an OLED device that corrects the variation of a threshold voltage of each driving transistor by sampling, storing, and restoring in real time the threshold voltage, and a method for driving the same.

In an exemplary embodiment of the present invention, a method of driving an organic light emitting display device includes: generating a luminance map for a plurality of pixels by applying the same driving voltage to driving transistors formed in the plurality of pixels of a panel and by capturing luminances of the pixels; generating a threshold voltage map by calculating threshold voltage correction values that compensate for threshold voltages of the driving transistors corresponding to the luminances of the pixels; generating a lookup table by sampling the threshold voltage correction values stored in the threshold voltage map; restoring the threshold voltage correction values by interpolating the sampled threshold voltage correction values; and correcting a driving voltage by adding the restored threshold voltage correction values to input gray level data and by providing the added value to the panel.

In another exemplary embodiment of the present invention, a method of driving an organic light emitting display device includes: calculating a threshold voltage correction value that compensates for a threshold voltage of each driving transistor from a luminance map for an organic light emitting display panel in which driving transistors are formed; sampling and storing the calculated threshold voltage correction value on a grid basis; restoring the threshold voltage correction value for each driving transistor from the sampled threshold voltage correction value by bilinear interpolation; and adding the restored threshold voltage correction value to input gray level data and applying the added value to the driving transistor.

In another exemplary embodiment of the present invention, an organic light emitting display device includes: an organic light emitting display panel in which driving transistors driving organic light emitting display elements are formed; a threshold voltage decoder that includes a lookup table in which threshold voltage correction values of driving transistors are sampled and stored, and restores the threshold voltage correction values of the driving transistors from the sampled threshold voltage correction values; and an adder that adds the threshold voltage correction values to input gray level data and provides the added values to the organic light emitting display panel.

A better understanding of the above and many other features and advantages of the OLED device and a method for driving the same disclosed herein may be obtained from a consideration of the detailed description thereof below, particularly if such consideration is made in conjunction with the several views of the appended drawings, wherein like elements are referred to by like reference numerals throughout.

DETAILED DESCRIPTION OF THE INVENTION

Exemplary embodiments of the present invention are described with reference to the accompanying drawings in detail. Detailed descriptions of well-known functions and structures incorporated herein are omitted to avoid obscuring the subject matter of the present invention.

Figure 1:
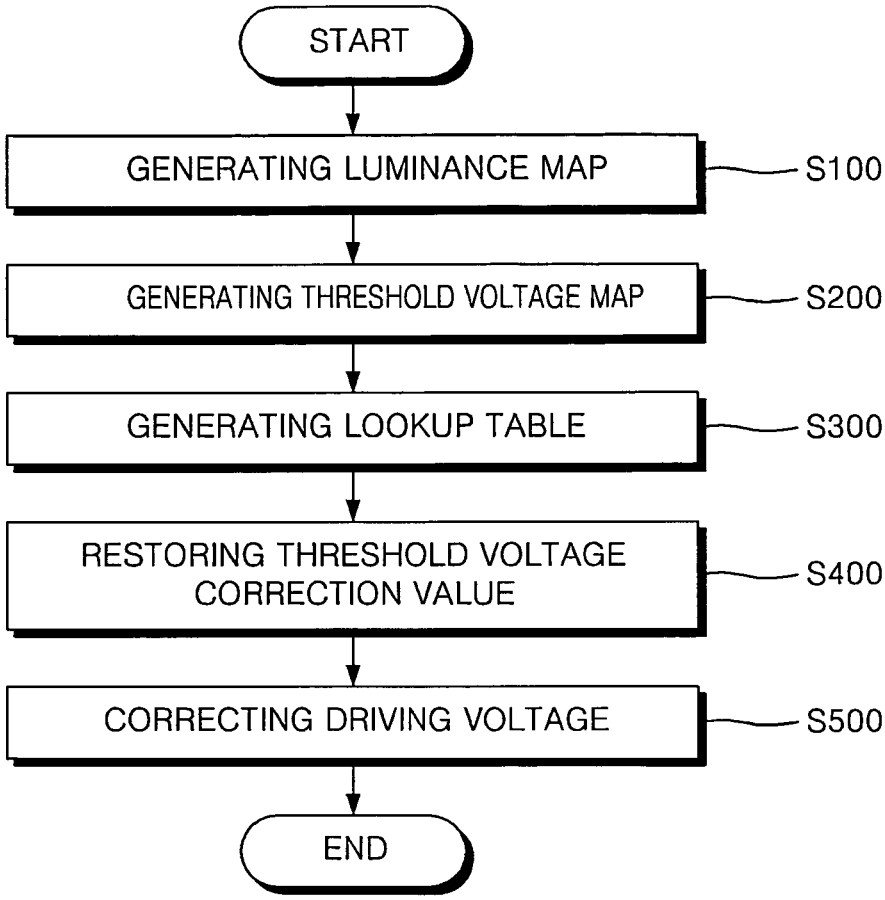
FIG. 1 is a flow chart showing a driving method of an OLED device according to an exemplary of the present invention.

FIG. 1 is a flow chart showing a driving method of an OLED device according to an exemplary embodiment of the present invention.

Referring to FIG. 1, a method for driving an OLED device includes generating a luminance map (S100), generating a threshold voltage map (S200), generating a lookup table (S300), restoring a threshold voltage correction value (S400), and correcting a driving voltage (S500).

In generating the luminance map (S100), a driving voltage corresponding to a predetermined gray level is applied to a pixel of an OLED panel and then light-emitting luminance of the pixel is captured to generate the luminance map for the OLED panel.

More particularly, driving voltages corresponding to, for example, 100 gray levels are applied to the driving transistors of all pixels and then a front surface of the OLED panel is captured by an inspection unit, such as a camera.

The captured image is transferred to a computer through an interface such as a universal serial bus ("USB"). The image transferred to the computer is stored as the luminance map for the OLED panel. Threshold voltages of the driving transistors of the pixels of the OLED panel may be different from each other due to errors in a fabricating process of the thin film transistors.

Even though a driving voltage corresponding to the same gray level is applied to the driving transistors of the pixels, the luminances displayed at the respective pixels of the OLED panel may be different from each other due to the variation of the threshold voltage. Accordingly, different luminance values are stored in the luminance map due to the variation of the threshold voltage.

The luminance map generating procedure (S100) may include initializing the luminance of the OLED panel to zero before the driving voltages corresponding to the predetermined gray levels are applied to the OLED panel. For example, a black gray voltage corresponding to a gray level of '0', that is, the lowest voltage, may be applied to the OLED panel to initialize the OLED panel.

In generating the threshold voltage map (S200), the threshold voltage map for the OLED panel is generated from the luminance map. The process for generating the threshold voltage map (S200) includes removing noise, calculating the threshold voltage, implementing gamma correction, and implementing scaling. This is described more fully below in the explanation of the process shown in FIG. 2. The threshold voltage map has a threshold voltage correction value for each driving transistor of the OLED panel.

In generating the lookup table (S300), the lookup table is generated by sampling the threshold voltage correction values included in the threshold voltage map on a grid basis. For example, when the OLED panel is 4.3-inch WqVGA (480×272), the threshold voltage correction value may be sampled on a 16-pixel or 32-pixel grid basis. When the threshold voltage correction value is sampled in 32-pixel grid unit, the lookup table has 16 (=480/32+1) points in a horizontal direction and 10 (=272/32+1) points in a vertical direction.

As opposed to the threshold voltage map generating procedure (S200) in which the threshold voltage correction values of all the driving transistors of the OLED panel are stored, the lookup table generating procedure (S300) may use a lookup table with a small size by storing the threshold voltage correction values of the driving transistors that are sampled on a grid basis. For example, when the threshold voltage correction value has a range of 256 gray levels of 8 bits, the lookup table has a size of 1280 bits (=16×10×8 bits), that is, a 1.25-Kb size.

The lookup table generated from the lookup table generating procedure (S300) may be transferred to a memory of the OLED device through an $I^2C$ interface etc.

In restoring the threshold voltage correction value (S400), the threshold voltage correction values of the driving transistors sampled and stored in the lookup table are interpolated by, for example, using bilinear interpolation.

In correcting the driving voltage (S500), the corresponding threshold voltage correction value is added to input gray level data and then the added value is applied to each driving transistor of the OLED panel. The input gray level data may be gamma-corrected and scaled through the threshold voltage map generating procedure (S200).

Since generating the luminance map (S100), generating the threshold voltage map (S200), and generating the lookup table (S300) are processes to generate the lookup table by sampling the threshold voltage correction values for the driving transistors of the OLED panel, these processes may be implemented during fabrication of the OLED device. In contrast, since restoring the threshold voltage (S400), and correcting the driving voltage (S500) are processes to remove the difference of the threshold voltage of the OLED panel in real-time by interpolating the threshold voltage correction values stored in the lookup table, theses processes may be implemented by users in the course of using the OLED device.

The threshold voltage map generating procedure (S200) from the luminance map is described below in more detail.

Figure 2:
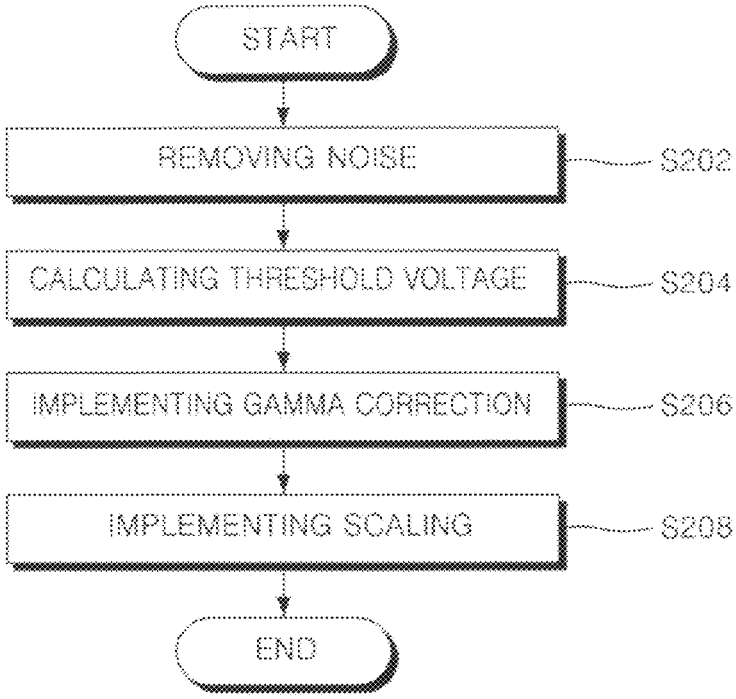
FIG. 2 is a flow chart showing a threshold voltage map generating procedure illustrated in FIG. 1.

FIG. 2 is a flow chart showing the threshold voltage map generating procedure illustrated in FIG. 1.

Referring to FIG. 2, the threshold voltage map generating procedure (S200) includes removing noise (S202), calculating a threshold voltage (S204), implementing gamma correction (S206), and implementing scaling (S208).

In removing noise (S202), noise included in the luminance map, that is, noise included in a captured image is removed by noise filtering or geometrical correction. Geometrical correction means correcting an edge of a distorted part of the captured image due to a spherical aberration of a camera lens to a rectangular shape.

In calculating the threshold voltage (S204), the threshold voltages of all the driving transistors of the OLED panel are calculated from the luminance map in which noise is removed. Calculating the threshold voltage may use the relationship between the threshold voltage and the luminance of the pixel. That is, assuming that the same driving voltage is applied to each of the driving transistors of the OLED panel, a current flowing into an OLED element is decreased when the threshold voltage of the driving transistor is high, thereby lowering the luminance of the pixel. And when the threshold voltage of the driving transistor is low, a current flowing into the OLED element is increased, thereby increasing the luminance of the pixel. An optimal relationship between the luminance of the pixel and the threshold voltage of the driving transistor may be appropriately selected by experiment.

In implementing the gamma correction (S206), the gamma correction is implemented such that gray level data input to the OLED device may have a substantially linear relationship with a gray level voltage Vp applied to the driving transistor of the OLED panel. This is to restore an original gamma value $\gamma$ by a relationship between the gray level voltage Vp and a drain-source current Ids of the driving transistor and between the drain-source current Ids and a luminance L of the pixel. The original gamma value $\gamma$ means a gamma value representing a change of a luminance according to a change of the gray level data.

This will be more particularly explained by the following [Equation 1] and [Equation 2]:

$$L=I_{ds}^{\gamma 1},\ I_{ds}=V_p^{\gamma 2},\ V_p=G^{\gamma 3} \quad \text{[Equation 1]}$$

In [Equation 1], L is a luminance, Ids is a drain-source current of a driving transistor, Vp is a gray level voltage for driving a driving transistor, G is gray level data, γ1 is a gamma value representing a change of the luminance L according to a change of the drain-source current Ids, γ2 is a gamma value representing a change of the drain-source current Ids according to a change of the gray level voltage Vp, and γ3 is a gamma value representing a change of the gray level voltage Vp according to a change of the gray level data G.

The change of the luminance L according to the change of the gray level data G based on [Equation 1] may be represented as a gamma value by the following [Equation 2]:

$$L=G^{\gamma 1\cdot\gamma 2\cdot\gamma 3}=G^{\gamma} \quad \text{[Equation 2]}$$

For example, when γ1 is 1.0, γ2 is 2.0, and the original gamma value γ applied to the OLED device is about 2.2 to about 2.4, the gamma correction may be implemented such that γ3 has a gamma value of about 1.1 to about 1.2.

In implementing the scaling (S208), all the gray level voltages corresponding to all the gray level data used in the OLED device are scaled to calculate the threshold voltage correction values of the respective driving transistors of the OLED panel and to generate the threshold voltage correction values as a threshold voltage map.

For example, when all the gray level data is 1024, a range of the gray level voltages corresponding thereto is 16V, and the maximum gray level voltage to be scaled is 12V, then the range of the gray levels is 768. 4V corresponding to the other 256 gray levels of 1024 gray levels may be allocated to the gray level voltage corresponding to the threshold voltage correction value.

Figure 3:
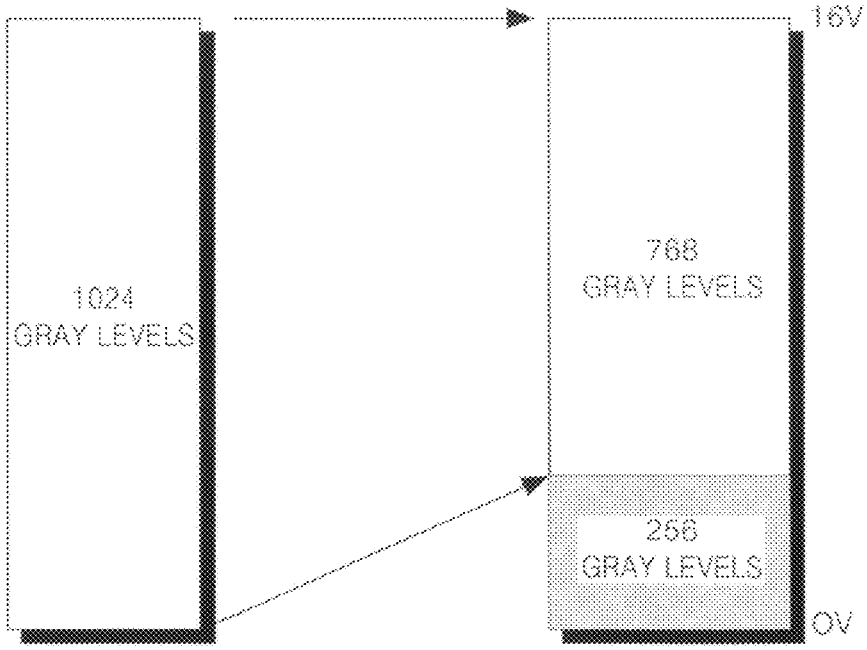
FIG. 3 is a view showing a scaling implementing procedure illustrated in FIG. 2.

FIG. 3 is a view showing the scaling implementing procedure illustrated in FIG. 2.

The threshold voltage of each driving transistor of the OLED panel calculated from the threshold voltage calculating procedure (S204) is gamma-corrected according to the 73 curve obtained from the gamma correction implementing procedure (S206) and calculated as the threshold voltage correction value through the scaling implementing procedure (S208), thereby being generated as the threshold voltage map.

The threshold voltage restoring procedure (S400) and the driving voltage correcting procedure (S500) is explained below in more detail through a configuration and operation of the OLED device according to an exemplary of the present invention.

Figure 4:
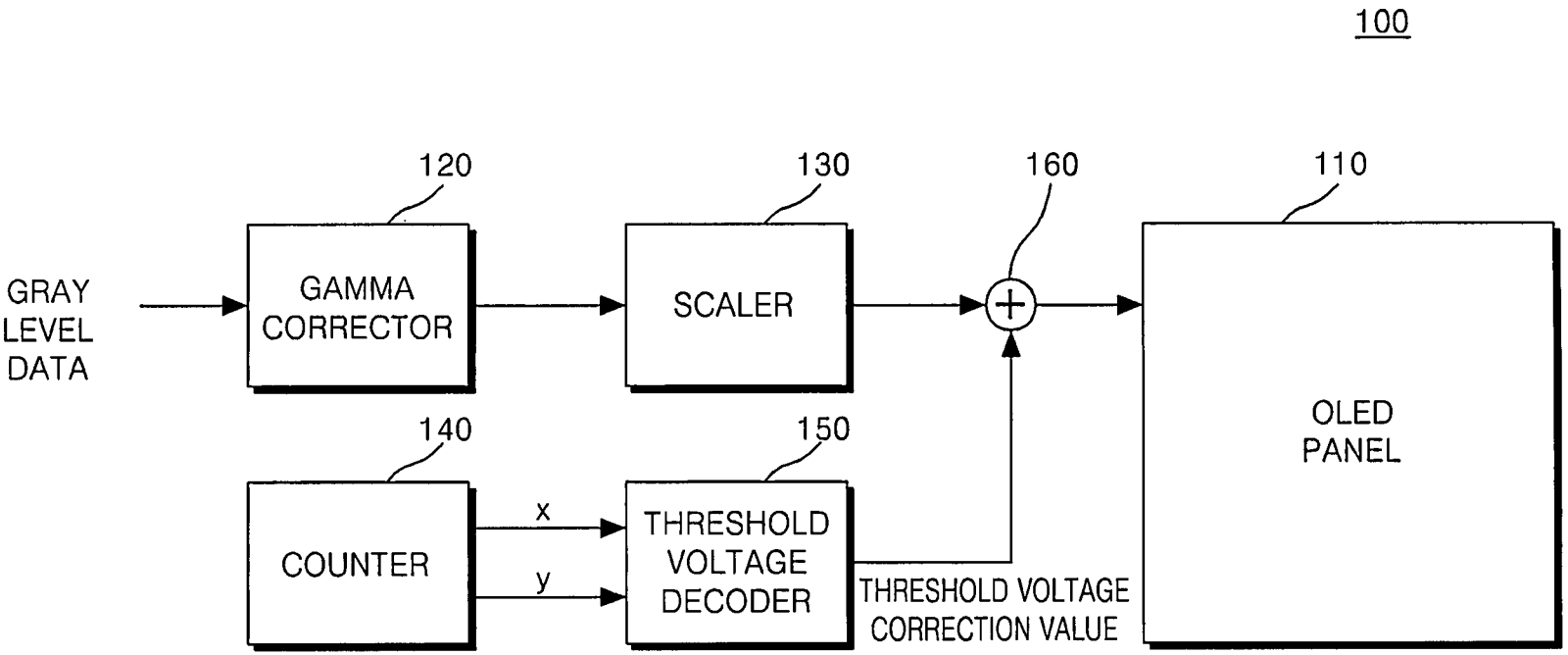
FIG. 4 is a block diagram showing an OLED device according to an exemplary embodiment of the present invention.

FIG. 4 is a block diagram of an OLED device according to an exemplary embodiment of the present invention.

Referring to FIG. 4, an OLED device 100 includes an OLED panel 110, a gamma corrector 120, a scaler 130, a counter 140, a threshold voltage decoder 150, and an adder 160.

The OLED panel 110 includes a plurality of data lines that provide a gray level voltages, a plurality of scan lines that provide a scan signals, a power line that provides power, and a plurality of pixels arranged in a matrix shape. The gray level voltage is a voltage that corresponds to gray level data provided from the adder 160. Each pixel includes a switching transistor, a capacitor, and a driving transistor.

The gamma corrector 120 implements gamma correction so that the relationship between a variation of input gray level data and a variation of a gray level voltage is substantially linear. The gamma corrector 120 may implement the gamma correction through the gamma correction implementing procedure (S206) illustrated in FIG. 2 so that a gamma curve showing the change of the gray level voltage according to the change of the input gray level data has a gamma value of about 1.1 to about 1.2.

The scaler 130 scales the input gray level data gamma-corrected by the gamma corrector 120 and provides the scaled data to the adder 160. For example, when a full-white gray level of the input gray level data is 1024 and the full-white gray level of the scaled gray level data corresponding thereto is 768, the scaler 130 may scale the input gray level data using a proportional relation.

The counter 140 generates a counting signal (x, y) outputting a correction value of the threshold voltage stored in the lookup table (152 of FIG. 5) to provide the counting signal to the threshold voltage decoder 150. Herein, x of the counting signal is the abscissas of the lookup table, and y of the counting signal is the ordinate of the lookup table. When the threshold voltage decoder 150 restores the threshold voltage correction value using the bilinear interpolation, the counter 140 may generate the counting signal that outputs 4 sampled threshold voltage correction values at a time and provides the generated counting signal to the threshold voltage decoder 150.

The threshold voltage decoder 150 interpolates in real-time the 4 sampled threshold voltage correction values output by the counting signal (x, y) by using the bilinear interpolation to calculate all the threshold voltage correction values applied to the respective driving transistors of the OLED panel 110 and sequentially provides the calculated threshold voltage correction values to the adder 160.

The adder 160 adds the input gray level data scaled from the scaler 130 to the corresponding threshold voltage correction value provided from the threshold voltage decoder 150 and provides the added value to the OLED panel 110.

Figure 5:
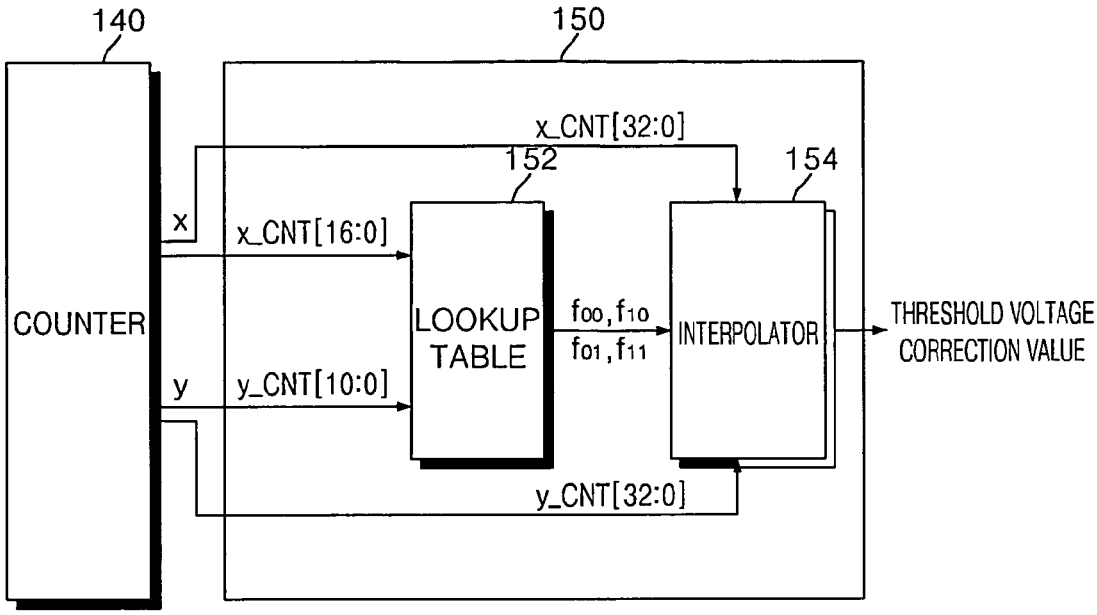
FIG. 5 is a block diagram showing a threshold voltage decoder illustrated in FIG. 4.

FIG. 5 is a block diagram showing an implementation of the threshold voltage decoder 150 illustrated in FIG. 4.

Referring to FIG. 5, the threshold voltage decoder 150 includes a lookup table 152 and an interpolator 154.

The lookup table 152 is a memory in which the sampled threshold voltage correction values are stored. When the OLED panel 110 is 4.3-inch WqVGA (480×272) and the threshold voltage correction values are sampled on a 32-pixel grid basis, the lookup table 152 outputs 4 threshold voltage correction values $f_{00}$, $f_{10}$, $f_{01}$, and $f_{11}$ at a time in response to a counting signal (x_CNT[16:0], y_CNT[10:0]). The threshold voltage correction values $f_{00}$, $f_{10}$, $f_{01}$, and $f_{11}$ are provided to the interpolator 154.

The interpolator 154 restores a threshold voltage correction value f of the sampled pixel by interpolating the 4 threshold voltage correction values $f_{00}$, $f_{10}$, $f_{01}$, and $f_{11}$ in response to a counting signal (x_CNT[32:0], y_CNT[32:0]) by the bilinear interpolation. This can be expressed by the following [Equation 3]:

$$f=\frac{(32-x)(32-y)}{32\times 32}f_{00}+\frac{x(32-y)}{32\times 32}f_{10}+\frac{(32-x)y}{32\times 32}f_{01}+\frac{xy}{32\times 32}f_{11} \quad \text{[Equation 3]}$$

In [Equation 3], x corresponds to the counting signal x_CNT[32:0], and y corresponds to the counting signal y_CNT[32:0]. Accordingly, when each of x and y is sequentially changed from 0 to 32, all the threshold voltage correction values between the 4 threshold voltage correction values $f_{00}$, $f_{10}$, $f_{01}$, and $f_{11}$ may be restored in real-time.

Figure 6:
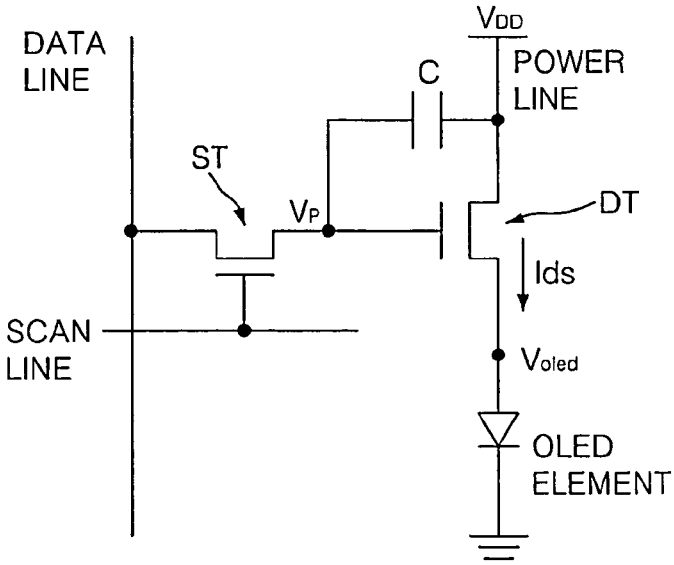
FIG. 6 is an equivalent circuit diagram of a pixel unit for an OLED panel shown in FIG. 4.

FIG. 6 is an equivalent circuit of a pixel unit of the OLED panel shown in FIG. 4.

Referring to FIG. 6, the unit pixel of the OLED panel 110 includes a switching transistor ST that switches a gray level voltage Vp provided from a data line in response to a scan signal provided from a scan line; a driving transistor DT that controls a drain-source current Ids in response to the gray level voltage Vp; a capacitor C that maintains the gray level voltage Vp during on frame period; and an OLED element that emits light as a function of the drain-source current Ids. The gray level voltage Vp applied to the driving transistor DT is a voltage corresponding to the gray level data provided from the adder 160 shown in FIG. 4. The gray level voltage Vp is applied to the gate of the driving transistor DT to compensate for the threshold voltage of the driving transistor DT.

Compensating for the threshold voltage of the driving transistor DT by the gray level voltage Vp is explained with reference to the following Equations.

$$I_{ds}=K(V_{gs}-V_{th})^2=K(V_p-V_{oled}-V_{th})^2 \quad \text{[Equation 4]}$$

In [Equation 4], Ids is the drain-source current flowing into the driving transistor DT that is driven in a saturation area. The drain-source current Ids may be represented by a gate-source voltage Vgs of the driving transistor DT and the threshold voltage Vth of the driving transistor DT. A constant K may be influenced by a size of the driving transistor, mobility, capacitance, etc.

Since the gate-source voltage Vgs of the driving transistor DT may be expressed by a difference between the gray level voltage Vp and an OLED element voltage Voled.

$$I_{dS}=K(V_G+V_{thc}-V_{oled}-V_{th})^2\approx K(V_G-V_{oled})^2 \quad \text{[Equation 5]}$$

Referring to [Equation 5], the gray level voltage Vp of [Equation 4] may be expressed as the sum of a voltage $V_G$ corresponding to the scaled gray level data (provided from the scaler 130 shown in FIG. 4) and a correction voltage Vthc corresponding to the threshold voltage correction value. When the correction voltage Vthc approximates to the threshold voltage Vth so that a difference between the threshold voltage Vth and the correction voltage Vthc is sufficiently small, the drain-source current Ids is not dependent on the threshold voltage Vth.

Accordingly, since the drain-source current Ids is not influenced by variations of the threshold voltages of the driving transistors that may be generated during fabrication of the OLED panel, the luminance uniformity of the OLED panel 110 may be improved.

Figure 7:
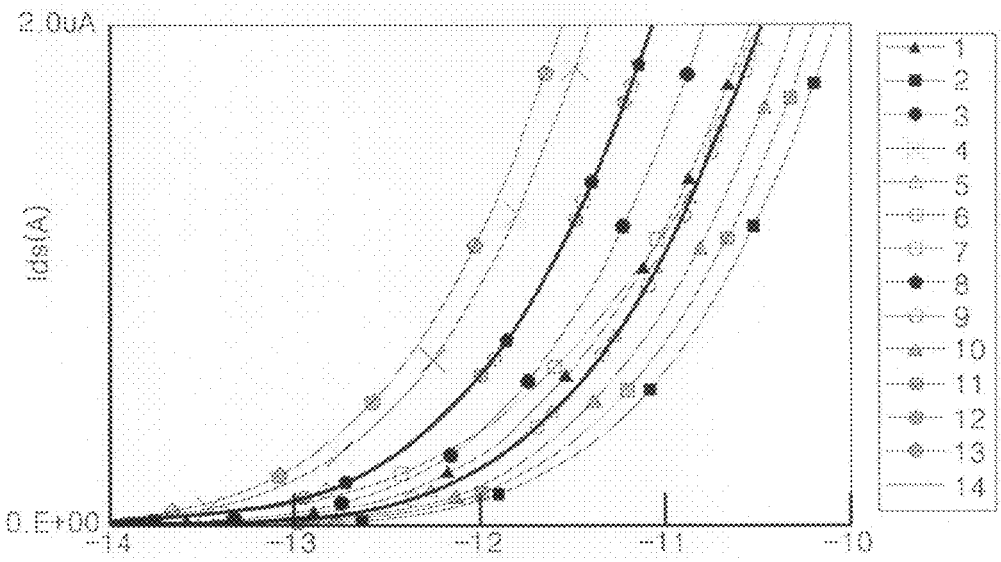
FIG. 7 is a plot showing a characteristic of an OLED panel according to the related art.
Figure 8:
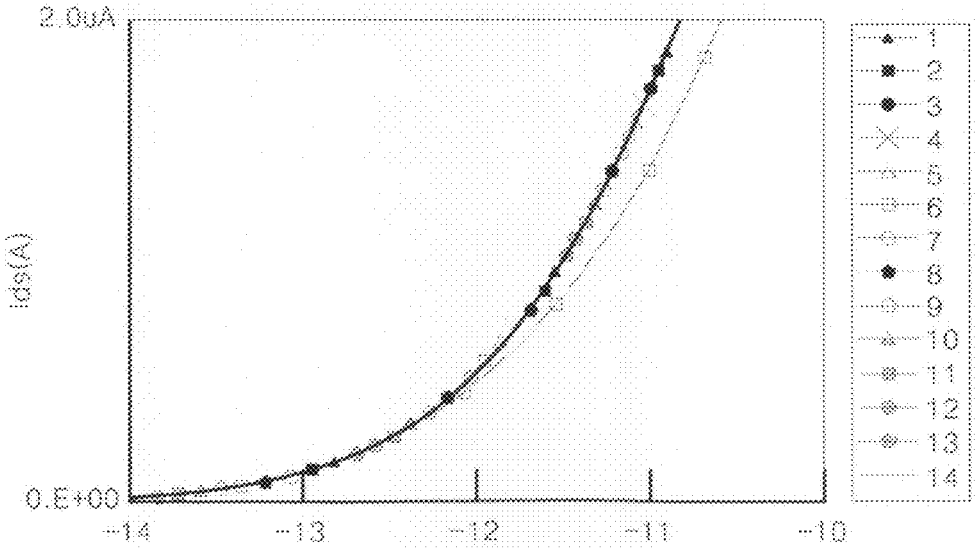
FIG. 8 is a plot showing a characteristic of an OLED panel according to an exemplary embodiment of the present invention.

FIG. 7 is a graph showing a characteristic of an OLED panel according to the related art, and FIG. 8 is a graph showing a characteristic of an OLED panel according to an exemplary embodiment of the present invention. In FIG. 7 and FIG. 8, the x-axis shows the gate-source voltage Vgs of the driving transistor, the y-axis shows the drain-source current Ids of the driving transistor. The fourteen curves represented by fourteen different line widths shown to the right in the figures illustrate the operating characteristics of fourteen driving transistors included in fourteen selected pixels of the OLED panel.

Referring to FIG. 7, in the OLED panel according to the related art, although the same gate-source voltage Vgs is applied to the fourteen driving transistors, the drain-source currents Ids of the driving transistors vary significantly. This is because the threshold voltage of each driving transistor of the OLED panel is not alike in view of fabricating error. The variation of the threshold voltages may lead to non-uniform luminance of the display.

Referring to FIG. 8, in the OLED panel according to the embodiment exemplary of the present invention, when the same gate-source voltage Vgs is applied to the fourteen driving transistors, the drain-source currents Ids of the driving transistors are nearly uniform.

This shows that the variations of the threshold voltages of the driving transistors generated during fabrication of OLED panel has been corrected.

The embodiment of the present invention improves the luminance non-uniformity by sampling and restoring in real-time the threshold voltage of the driving transistor and correcting the variation of the threshold voltage.

The embodiments of the present invention are applicable to devices which are lightweight, compact and have low power consumption, such as mobile communication devices, multimedia devices, and large-sized television receivers.

While the invention has been shown and described with reference to a certain exemplary embodiment thereof, it will be understood by those skilled in the art that various changes in form and details may be made therein without departing from the spirit and scope of the invention as defined by the appended claims

What is claimed is:

1. A method of driving an organic light emitting display device, comprising:

generating a luminance map for a plurality of pixels by applying a driving voltage having a common magnitude to driving transistors associated with the plurality of pixels of a display panel and capturing a luminance associated with each of the pixels;

generating a threshold voltage map by calculating threshold voltage correction values that compensate for threshold voltage variation of the driving transistors corresponding to luminances of the pixels;

generating a lookup table by sampling the threshold voltage correction values stored in the threshold voltage map to generate sampled threshold voltage correction values stored in the lookup table, wherein the plurality of pixels is divided into a plurality of grid units, and each of the sampled threshold voltage correction values is sampled from a plurality of threshold voltage correction values corresponding to multiple pixels in a grid unit of the plurality of grid units;

restoring the threshold voltage correction values by interpolating the sampled threshold voltage correction values; and correcting a driving voltage by adding the restored threshold voltage correction values to input gray level data to generate added values and by providing the added values to the display panel, wherein the generating the threshold voltage map comprises:

calculating the threshold voltages corresponding to the luminances of the pixels by using correlation between the luminances of the pixels and the threshold voltages of the driving transistors formed in the pixels;

implementing gamma correction such that the input gray level data has a substantially linear relation with gray level voltages applied to the driving transistors; and scaling the gray level voltages corresponding to the gray level data to generate gamma-corrected threshold voltages as the threshold voltage correction values and to generate the threshold voltage correction values as the threshold voltage map.

2. The method of claim 1, wherein the panel is an organic light emitting display panel that includes an organic light emitting display element driven by the driving transistor.

3. The method of claim 2, wherein generating the lookup table comprises sampling the plurality of pixels on a grid basis and storing the threshold voltage correction values corresponding to the sampled pixels in the lookup table.

4. The method of claim 1, wherein generating the threshold voltage map further comprises removing noise included in the luminance map by noise filtering or geometric correction.

5. The method of claim 1, wherein correcting the driving voltage comprises:

implementing gamma correction such that the input gray level data has a substantially linear relation with the gray level voltages; and scaling the input gray level data and adding the scaled gray level data to the threshold voltage correction values.

6. The method of claim 2, wherein restoring the threshold voltage correction values is implemented by bilinear interpolation.

7. The method of claim 2, wherein generating the luminance map comprises applying a driving voltage corresponding to a black gray level to the driving transistors before applying the same driving voltage to the driving transistors.

* * * * *